US011578429B2

(12) United States Patent
Angelico

(10) Patent No.: US 11,578,429 B2
(45) Date of Patent: Feb. 14, 2023

(54) CUSP DIE FOR PRODUCING MELT-BLOWN NON-WOVEN FABRIC

(71) Applicant: CAT S.r.L., Teramo (IT)

(72) Inventor: Giuseppe Angelico, Teramo (IT)

(73) Assignee: CAT S.r.L., Teramo (IT)

( * ) Notice: Subject to any disclaimer, the term of this patent is extended or adjusted under 35 U.S.C. 154(b) by 305 days.

(21) Appl. No.: 16/930,978

(22) Filed: Jul. 16, 2020

(65) Prior Publication Data

US 2021/0277538 A1 Sep. 9, 2021

(30) Foreign Application Priority Data

Mar. 4, 2020 (IT) ..... 102020000004639

(51) Int. Cl.

| | |
|---|---|
| ***D01D 4/02*** | (2006.01) |
| ***D01D 5/098*** | (2006.01) |
| ***D04H 1/56*** | (2006.01) |
| ***D04H 3/16*** | (2006.01) |

(52) U.S. Cl.

CPC ..... *D01D 4/025* (2013.01); *D01D 5/0985* (2013.01); *D04H 1/565* (2013.01); *D04H 3/16* (2013.01)

(58) Field of Classification Search

CPC ..... D01D 4/025; D01D 5/0985; D04H 1/565; D04H 3/16

See application file for complete search history.

(56) References Cited

U.S. PATENT DOCUMENTS

| | | | | |
|---|---|---|---|---|
| 3,865,535 | A * | 2/1975 | Langdon | B29C 48/345 425/464 |
| 2002/0034909 | A1* | 3/2002 | Bansal | D01D 5/0985 442/361 |
| 2002/0125601 | A1* | 9/2002 | Allen | D01D 5/34 264/210.8 |
| 2002/0127293 | A1* | 9/2002 | Bentley | D01D 5/0985 425/72.2 |
| 2002/0170661 | A1* | 11/2002 | Rudisill | D01D 5/32 156/244.11 |
| 2004/0131713 | A1* | 7/2004 | Dzialas | D01D 4/025 425/382.2 |
| 2006/0084341 | A1* | 4/2006 | Bodaghi | D01D 5/32 442/361 |

* cited by examiner

*Primary Examiner* — Xiao S Zhao
*Assistant Examiner* — Joseph S Leyson
(74) *Attorney, Agent, or Firm* — Vorys, Sater, Seymour and Pease LLP

(57) ABSTRACT

A cusp die for producing melt-blown non-woven fabric is provided, defining a sagittal plane, a main extension direction on the sagittal plane, a first flank and a second flank mutually bounded by the sagittal plane and including an ejection portion extending along the main extension direction and designed to convey, in use, polymeric fluid towards an external air blade, at least one extrusion pipe configured to convey the polymeric fluid towards the ejection portion, a plurality of holes arranged in the ejection portion, placed in fluidic through connection with the extrusion pipe and communicating with the outside, wherein the holes are arranged along at least one first row and a second row that are distinct and arranged respectively at the first flank and the second flank.

7 Claims, 4 Drawing Sheets

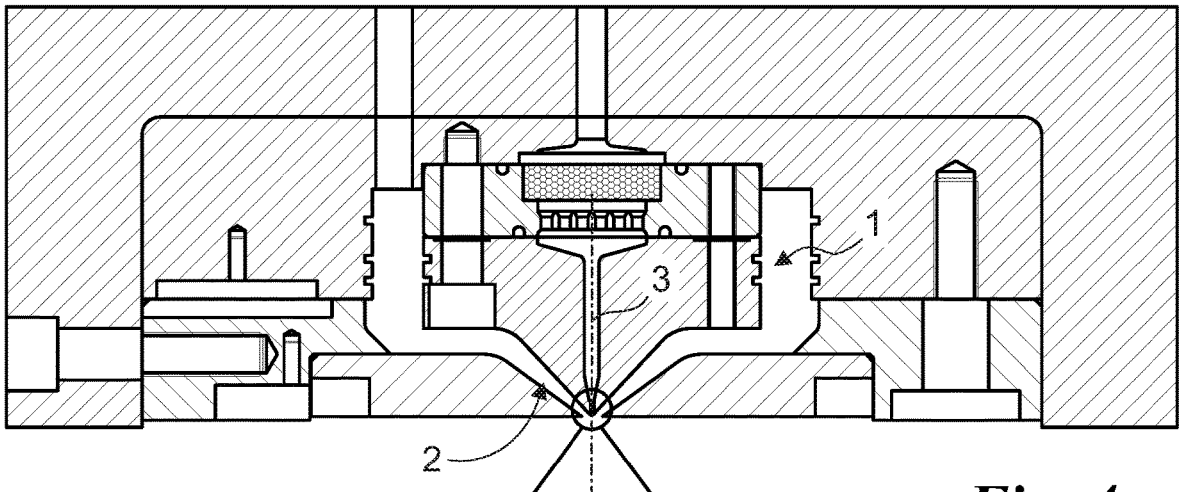
Fig. 4
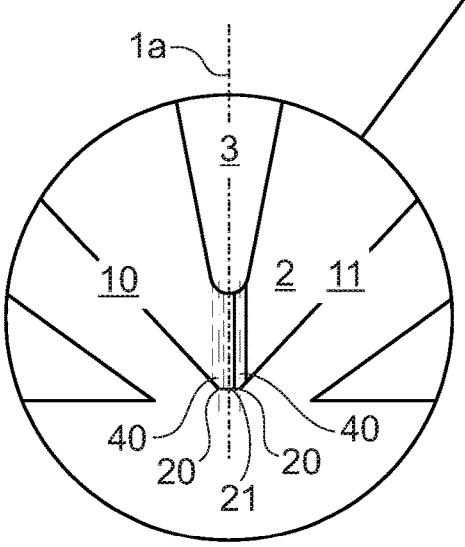
Fig. 5a
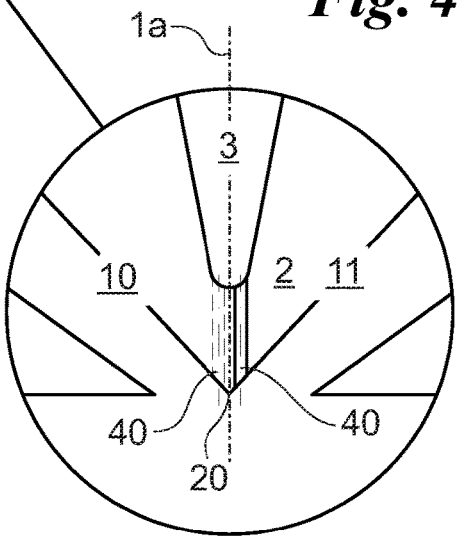
Fig. 5b
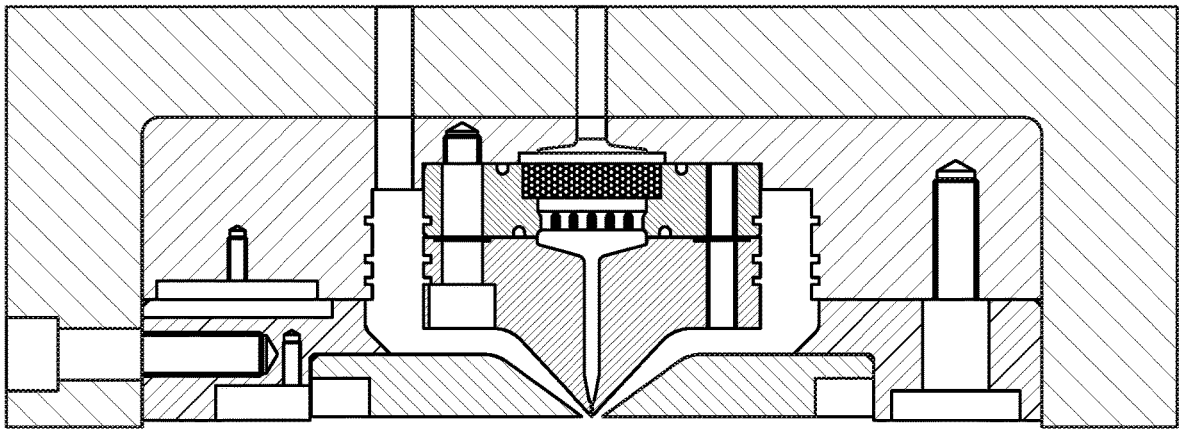
Fig. 6 (Known Art)

CUSP DIE FOR PRODUCING MELT-BLOWN NON-WOVEN FABRIC

FIELD OF THE INVENTION

This invention relates to a cusp die for producing melt-blown non-woven fabric of the type specified in the preamble of the first claim.

In other words, this invention relates to a die designed to produce non-woven fabric, also known by the acronym NW, from polymer filaments extruded through the die itself.

DESCRIPTION OF THE PRIOR ART

As is known, non-woven fabric, or NW, is an industrial product similar to a fabric, but which is obtained with methods other than weaving and knitting. Thus, in a non-woven fabric, the fibres have a random development, without identifying any orderly structure, while in a fabric, the fibres have two directions, which are prevalent and orthogonal to one another, usually known as the warp and weft.

At present, a number of products containing NW are made depending on the manufacturing technique used, which is mainly related to the way in which the product itself is used.

In particular, high-quality NWs for hygiene- and sanitary-type products are distinguished from low-quality NWs used above all for geotex.

From a technical point of view, non-woven fabrics can essentially be divided into spunlace, spunbond, and melt-blown.

Spunlace fabric undergoes processing, which gives the material equidirectional strength. Due to this property and to the possibility of its being produced in various materials, such as viscose, polyester, cotton, polyamide and microfibre, and to the possible finishes, i.e. smooth or perforated, and to the multitude of smooth or printed colours, spunlace is recommended for the hygiene and sanitary sector, for the automotive and cosmetic sectors, and for industrial or disposable uses.

Spunbond, which is usually made with polypropylene, is a non-woven fabric, which can be used in a variety of ways in the agricultural, hygiene and sanitary, construction, furniture, mattress, and other related sectors. By means of an appropriate treatment, it is possible to make a series of highly specific products for each sector: fluorescent, soft calendered, anti-mite, fireproof, anti-bacterial, anti-static, anti-UV and others. Furthermore, numerous finishes can be applied to Spunbond, such as printed, laminated, printed laminated in flexography and self-adhesive.

Melt-blown NW is made by means of specific spinnerets so as to obtain more sophisticated technical features than the previous NWs. In fact, melt-blown fabric is characterised by fibres with higher filtering power, both for liquid and aeriform substances.

Plants for producing non-woven melt-blown fabric are conventionally made up of components, as shown in FIG. 6.

These are composed of a box that encloses the device for producing melt-blown fibre and all the parts needed for the process to work optimally. In addition, known plants generally comprise a first support, a breaker plate, a cusp die, a second support, and an air blade.

The breaker plate is designed to channel and filter the polymer, usually polypropylene, towards the cusp die. The latter is a device comprising, as mentioned above, a perforated cusp portion designed to the polypropylene to exit under pressure.

The first support is basically an element connecting the box and the breaker plate, while the second support is, instead, designed to support the air blade and is arranged in such a way as to close the breaker plate and the melt-blown device inside the box.

Sometimes, the second support and the plates defining the air blade may be the same, limiting the plant components. The air blade, on the other hand, is composed of a casing wrapping the cusp of the melt-blown device so as to direct a flow of air, possibly non-turbulent, towards the holes of the cusp.

From a procedural point of view, the polymer material enters the box and starts its path inside it at a temperature of approximately 240-270° C.

It is first directed to the first support, then to the breaker plate and, finally, to the cusp die and, in particular, conducted under pressure towards the holes arranged on the cusp.

Usually, the cusp comprises 30 to 50 holes/inch aligned along a main direction with diameters ranging from 0.15 mm to 0.4 mm and with a hole depth ranging from 10-13 times the diameter.

As soon as the polymer comes out of the cusp holes, it is hit by the airflow coming from the two sides defined by the air blade.

The air blade is basically made up of two converging pipes up to an expulsion space, or slot, extending between 0.7 and 2 mm in which the air flows out at about 180°.

The acceleration of the air inside the blade makes it possible to create a flow that, in contact with the polymer, atomises the polymer, creating sprays comprising very fine particles that, in turn, lie on movable carpets with high speed.

The box, therefore, in addition to including the polymer inlet duct, includes air inlet ducts to feed the air blade.

The described prior art comprises some significant drawbacks.

In particular, as can be seen from the description, melt-blown technology is attached to specific component configurations and a well-defined procedure.

In particular, in order to produce a NW with good characteristics, it is necessary to increase the number of holes per inch and, above all, the polymer flow rate, or throughput. It is very difficult and expensive to drill holes under 0.15 mm diameter; therefore, the known technology has significant physical limitations. Many times, when the blades that wrap the cusp of the melt-blown get dirty with polymer, the polymer tends to burn, to get stuck between the blade and the cusp of the melt-blown causing the melt-blown to malfunction and damaging the quality of the product.

In particular, with the prior art cusp dies, it is possible to produce high quality non-woven fabric that does not, however, function well as a barrier to water or air. In fact, the above-mentioned shape of the holes does not enable the empty spaces present on the non-woven fabric to be minimised, thus reducing its efficiency.

SUMMARY OF THE INVENTION

In this context, the technical task underlying this invention is to devise a cusp die for producing melt-blown non-woven fabric, which is capable of substantially overcoming at least some of the above-mentioned drawbacks.

In the context of said technical task, it is an important aim of the invention to obtain a cusp die that deviates from the conventional technique in such a way as to make more efficient non-woven fabric without dimensional limitations in terms of fineness.

Another important purpose of the invention is to create a cusp die that drastically reduces the empty spaces between one fibre and another of the non-woven fabric in order to increase the barrier to water or air created by the fabric itself.

Another purpose of the invention is to create a cusp that makes it possible to increase the efficiency of the NW product without needing to modify the structure of the melt-blown plants as currently conceived.

An additional task of the invention is to obtain a cusp die compatible with current melt-blown plants.

The technical task and the specified purposes are achieved with a cusp die for producing melt-blown non-woven fabric defining a sagittal plane, a main extension direction on the sagittal plane, a first flank and a second flank mutually bounded by the sagittal plane and comprising an ejection portion extending along the main extension direction and designed to convey, in use, polymeric fluid towards an external air blade, at least one extrusion pipe configured to convey the polymeric fluid towards the ejection portion, a plurality of holes arranged in the ejection portion, placed in fluidic through connection with the extrusion pipe and communicating with the outside, wherein the holes are arranged along at least one first row and a second row that are distinct and arranged respectively at the first flank and the second flank.

BRIEF DESCRIPTION OF THE DRAWINGS

The characteristics and benefits of the invention will be clarified in the following detailed description of some preferred embodiments of the invention, with reference to the accompanying drawings, wherein:

FIG. 4 shows a cross-section view of a melt-blown plant including a cusp die for producing melt-blown non-woven fabric according to the invention;

FIG. 5*a* illustrates the detail of the holes in a cusp die for producing melt-blown non-woven fabric according to the invention in a first example;

FIG. 5*b* is the detail of the holes of a cusp die for producing melt-blown non-woven fabric according to the invention in a second example;

FIG. 6 represents a cross-section view of a prior art melt-blown plant;

DESCRIPTION OF THE PREFERRED EMBODIMENTS

Figure 1:
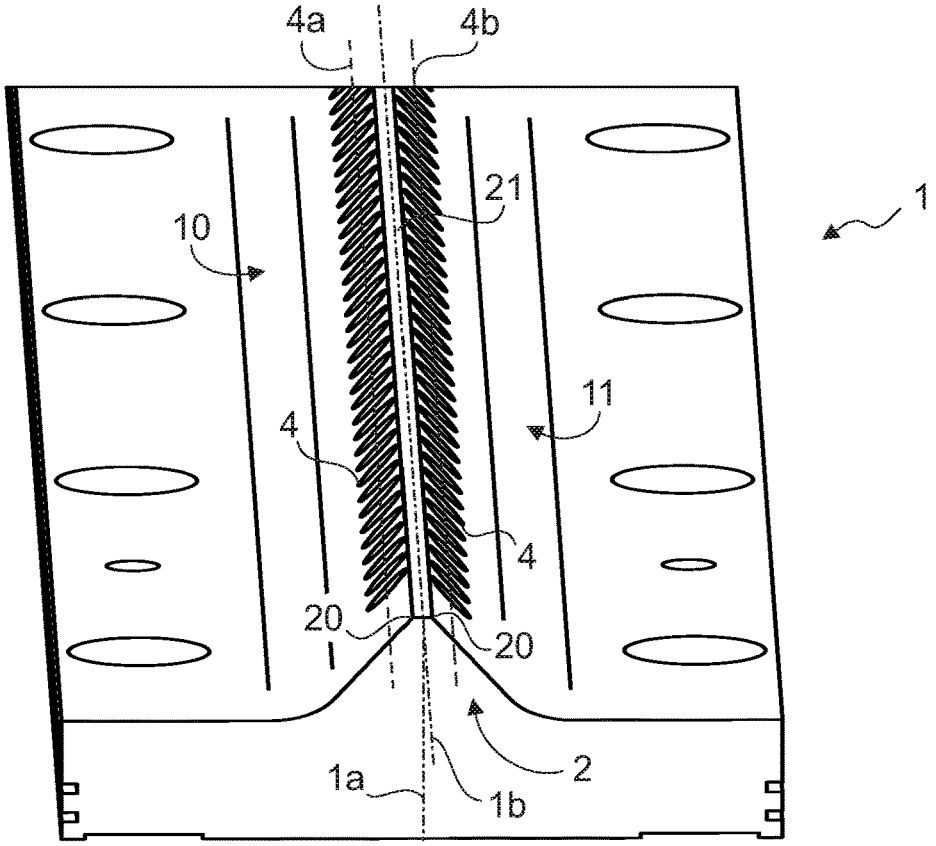
FIG. 1 shows a perspective view of a cusp die for producing melt-blown non-woven fabric according to the invention.

In this document, the measures, values, shapes and geometric references (such as perpendicularity and parallelism), when associated with words like "almost" or other similar terms such as "approximately" or "substantially", are to be understood as except for measurement errors or inaccuracies owing to production and/or manufacturing errors and, above all, except for a slight divergence from the value, measure, shape, or geometric reference with which it is associated. For example, if associated with a value, such terms preferably indicate a divergence of no more than 10% from the value itself.

Furthermore, when used, terms, such as "first", "second", "higher", "lower", "main", and "secondary" do not necessarily identify an order, relationship priority, or relative position, but they can simply be used to distinguish different components more clearly from one another.

Unless otherwise stated, the measurements and data reported in this text shall be considered as performed in International Standard Atmosphere ICAO (ISO 2533:1975).

With reference to the Figures, the cusp die for producing melt-blown non-woven fabric according to the invention is globally denoted with the reference number 1.

The die 1 is basically configured to be laid inside a melt-blown non-woven fabric plant.

Therefore, the die 1 preferably has, at least partially, a cusp or arrow shape.

The melt-blown plant that includes the die 1, comprises, as well as the die, basically conventional components.

The plant may comprise, as shown in FIG. 4, a box, a breaker plate, one or more supports, and an air blade.

The box is, usually, a U-shaped containment device, inside of which the plant components are laid.

In particular, the box preferably includes at least one main duct.

The main duct is preferably designed to enable polymeric fluid to pass through the box.

As happens with common melt-blown plants, the main duct is preferably designed to enable the passage of polymeric fluid approximately around 240° C.-270° C. In fact, for example, the polymeric fluid may consist of polypropylene.

The breaker plate preferably includes at least one or more direction pipes.

The direction pipes may be of the converging type. The direction pipes are preferably in fluidic through connection with the main duct and are designed, in any case, to direct the polymeric fluid or, rather, to convey the polymeric fluid along a pre-determined direction.

In addition, between the direction pipe and the main pipe, at least one filtering element is usually arranged in such a way as to filter the polymeric fluid before its expulsion from the plant.

The breaker plate is, thus, preferably attached to the box via a first support. The first support can, therefore, include a connection arranged between the main pipe and the direction pipes upstream of the filtering element, if present.

The die 1 is, therefore, preferably designed to be attached downstream of the breaker plate in order to receive the polymeric fluid filtered by the breaker plate.

In any case, the die 1 preferably defines a sagittal plane 1*a*.

The sagittal plane 1*a* is basically a mid-plane designed to divide the die 1 into two adjacent portions that are basically placed side-by-side.

The sagittal plane 1*a* defines, in addition, the extension plane along which the die 1 extends.

The die 1 is, thus, designed to be attached to the breaker plate, inside a melt-blown plant, in such a way that the sagittal plane 1*a* is parallel to the direction defined by the direction pipes. In other words, the die 1, when in use, is designed to be attached to the breaker plate in such a way that the sagittal plane 1*a* rests on the sagittal plane of the whole plant.

The die 1, thus, defines a first flank 10 and a second flank 11 in relation to the sagittal plane 1*a*.

The first flank 10 and the second flank 11 are mutually bounded by the sagittal plane 1*a*. They basically define, as shown in FIGS. 1-5*b*, a right and left flank of the die 1 when in use inside a plant.

The die 1, in addition, defines a main extension direction 1*b*.

The main extension direction 1*a* is a predetermined direction over the sagittal plane 1*a*. The first flank 10 and the second flank 11 basically extend along the main extension direction 1*b* placed side-by-side each other in relation to the sagittal plane 1*a*.

The die 1 thus comprises an ejection portion 2.

The ejection portion 2 extends along the main extension direction 1*b*. In particular, the ejection portion 2 preferably extends in such a way that it defines part of the first flank 10 and, at the same time, part of the second flank 11.

The ejection portion is, thus, basically divided preferably into two specular halves by the sagittal plane 1*a*.

The ejection portion 2 is, in any case, designed to convey polymeric fluid towards an air blade, when in use. The air blade is, as already suggested, an element external to the die 1. In particular, the air blade is a component of the melt-blown plant usually attached by means of a second support to the first support and close to the ejection portion 2 in such a way as to enable a controlled flow of air to hit the polymeric fluid as it comes out of the ejection portion 2.

In order to convey the polymeric fluid to the ejection portion 2, the die includes at least one extrusion pipe 3.

The extrusion pipe 3 is preferably configured to convey the polymeric fluid towards the ejection portion 2. In particular, the extrusion pipe 3 preferably extends along the sagittal plane 1*a*. In addition, it is designed, in use, to be placed in fluidic through connection with the direction pipe of the breaker plate in such a way that it receives fluid filtered by it.

The extrusion pipe 3 preferably extends perpendicularly to the main extension direction 1*b* of the die 1.

In addition, the die 1 could equally include a plurality of extrusion pipes 3 distributed along the main extension direction 1*b*, or parallel to it, each one extending perpendicularly to it and parallel to the other extrusion pipes 3.

The die 1 also comprises, therefore, a plurality of holes 4.

The holes 4 are preferably arranged in the ejection portion 2. In addition, the holes 4 are placed in fluidic through connection with the extrusion pipe 3 and communicating with the outside.

In fact, the holes 4 are configured to expel polymeric fluid towards the outside.

In addition, when the die 1 is in use in a plant, the holes 4 are arranged close to the air blade/s. In particular, the holes 4 are preferably arranged close to the die, or can be arranged astride the cusp, or half astride the cusp and half close to the blade.

The holes 4 may all be in fluidic through connection with an extrusion pipe 3, or they may each be in fluidic through connection with a single extrusion pipe 3.

Preferably, but not necessarily, the holes 4 extend perpendicularly to the main extension direction 1*b*, parallel to the sagittal plane 1*a*.

Advantageously, the holes 4 of the die 1 are not arranged or distributed along a single row, as with the prior art dies.

In particular, the holes 4 of the die 1 are arranged along at least one row 4*a* and a second row 4*b*.

The first row 4*a* and the second row 4*b* are distinct from each other, i.e. they are not the same. In addition, the rows 4*a*, 4*b* are preferably basically parallel to the main extension direction 1*b*. Even more specifically, at least one of them does not coincide with the main extension direction 1*b* or does not lie on the sagittal plane 1*a*.

In addition, the first row 4*a* is preferably arranged at the first flank 10. The second row 4*b* is preferably arranged at the second flank 11.

Even more specifically, the rows 4*a*, 4*b* are preferably arranged, as shown in FIGS. 1-5*b*, mirroring the sagittal plan 1*a*.

The fact that the holes 4 are arranged in two rows enables the creation of particular configurations.

The holes 4 are preferably arranged in the rows 4*a*, 4*b* alternately so that none of the holes 4 is placed side-by-side with another hole 4 along a direction perpendicular to the sagittal plane 1*a*. In other words, the holes 4 of one row 4*a*, 4*b* are placed next to the space separating two holes 4 in the other row 4*b*, 4*a*.

Even more specifically, in one preferred embodiment, the holes 4 are staggered between them along the main extension direction 1*b* in such a way that the space separating the adjacent holes 4 of the same row 4*a*, 4*b* is smaller than the extension along the row 4*a*, 4*b* of the hole 4 of the other row 4*b*, 4*a* placed alongside the separation space.

In other embodiments, the adjacent holes 4 of the same row 4*a*, 4*b* may define a separation space approximately equal to the extension along its own row 4*a*, 4*b* of the hole 4 of the other row 4*b*, 4*a* placed side-by-side with the separation space.

Or, the adjacent holes 4 of one same row 4*a*, 4*b* may define a separation space less than the extension along its own row 4*a*, 4*b* of the hole 4 of the other row 4*b*, 4*a* placed alongside the separation space. However, in the latter case, it is preferable that the separation space is, in any case, limited in order to obtain a high-quality non-woven fabric.

The arrangement of the holes 4 can, therefore, be defined according to various configurations.

Figure 2:
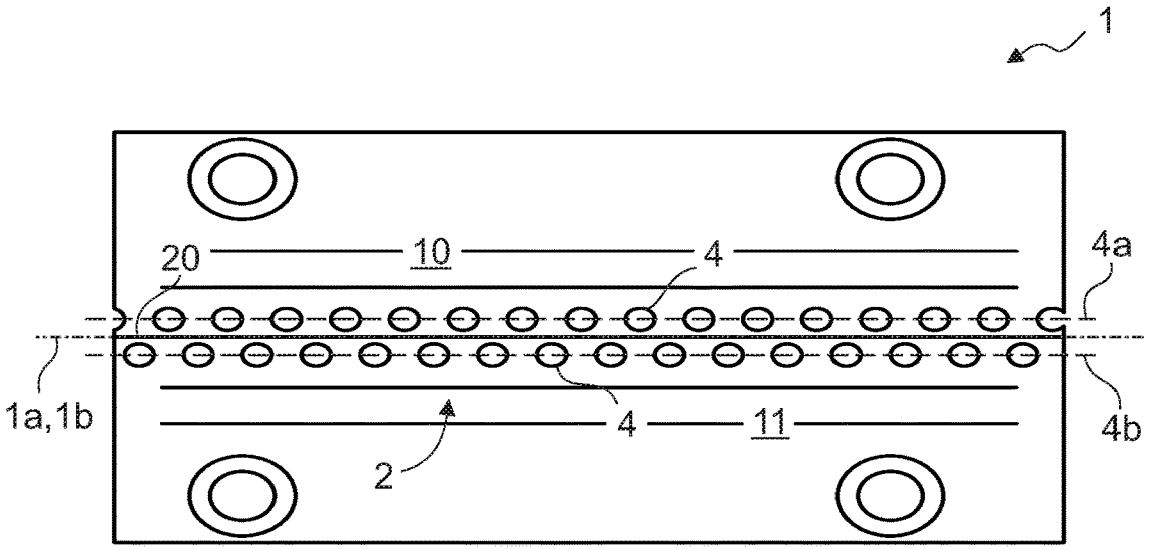
FIG. 2 illustrates a longitudinal view of a cusp die for producing melt-blown non-woven fabric according to the invention.

For example, with reference to FIGS. 2 and 5*b*, the ejection portion 2 may exclusively define an edge 20.

The edge 20 may be a pointed portion, i.e. geometrically defining a point of singularity defining left and right derivatives, corresponding to the derivative on the first and second flank 10, 11 that do not coincide with each other.

The edge 20 is, in addition, preferably aligned with the main extension direction 1*b* and lies on the sagittal plane 1*a*.

In other words, the edge 20 extends on the sagittal plane 1*a* parallel to the main extension direction 1*b*.

The rows 4*a*, 4*b* are, thus, specularly placed alongside the edge 20.

Alternatively, as shown in FIGS. 1, 3*a*-3*b*, 5*a*, the die 1 may define two edges 20.

In this case, the two edges 20 extend parallel to the main extension direction 1*b* and to the sagittal plane 1*a*. In addition, the ejection portion 2 defines a flat surface 21.

The flat surface 21 is preferably perpendicular to the sagittal plane 1*a*. In addition, the flat surface 21 is basically bounded by the edges 20 and extends along the main extension direction 1*b*.

In this embodiment, then, at least three different hole 4 configurations can be defined.

Figure 3A:
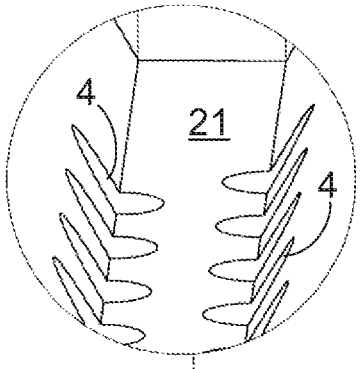
FIG. 3*a* is a detailed view of the holes in a cusp die for producing melt-blown non-woven fabric according to the invention.
Figure 3B:
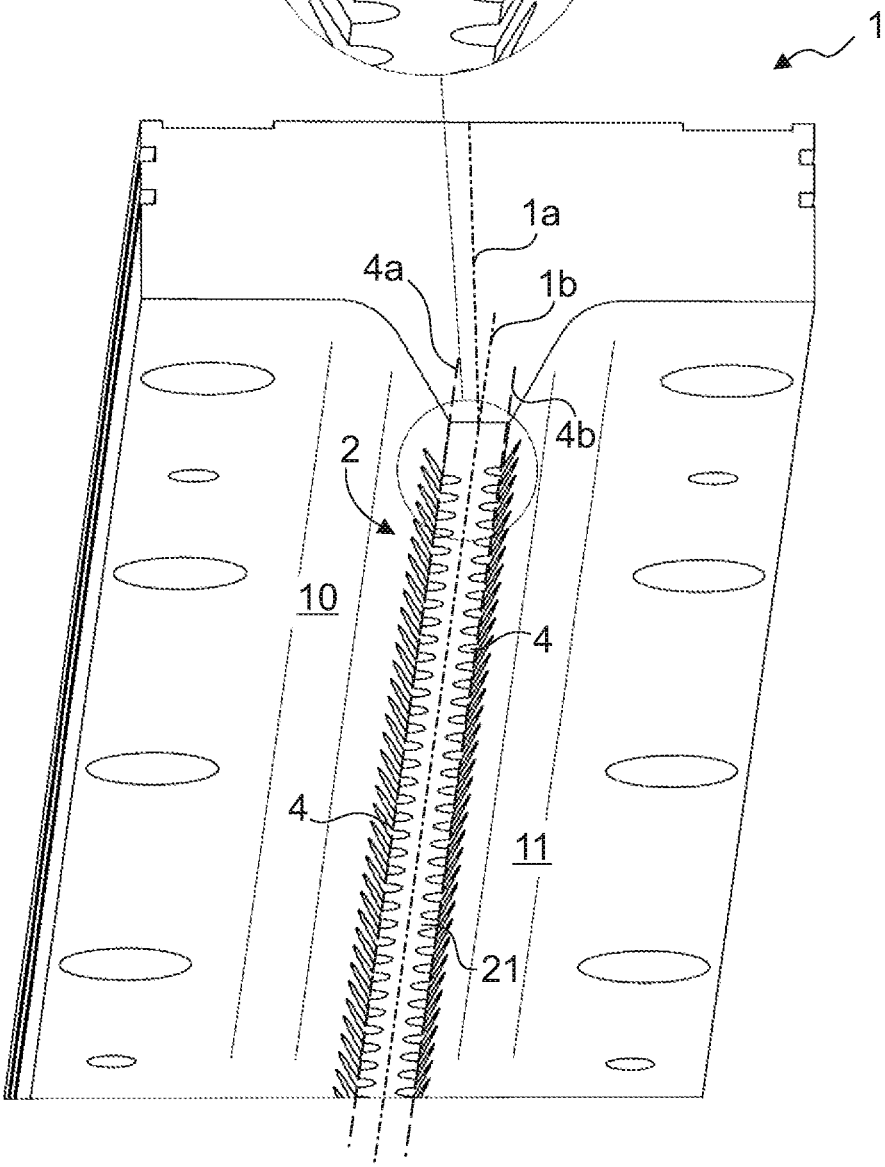
FIG. 3*b* represents a perspective view of a cusp die for producing melt-blown non-woven fabric according to the invention.

For example, in a first configuration shown in FIGS. 3*a*-3*b*, 5*a*, the rows 4*a*, 4*b* are preferably arranged and extend on the edges 20. In this way, at least part of the holes 4 extend on the flat surface 21.

In a second, alternative configuration, shown in FIG. 1, the rows 4*a*, 4*b* extend parallel to the edges 20 outside the flat surface 21 in such a way that none of the holes 4 extend across the flat surface 21.

In a third, alternative configuration, not shown in the figures, they extend parallel to the edges 20 across the flat surface 21 in such a way that all the holes 4 extend across the flat surface 21.

The die 1, of course, could also be made by combining the three configurations.

For example, the holes 4 could be arranged in more than two rows 4*a*, 4*b* and could be partially arranged on the edge 20 and/or on the flat surface 21 and/or outside the flat surface 21.

In addition, the holes 4 could also be arranged in more than two rows 4*a*, 4*b* in the embodiment wherein the ejection portion includes one edge 20.

Figure 7:
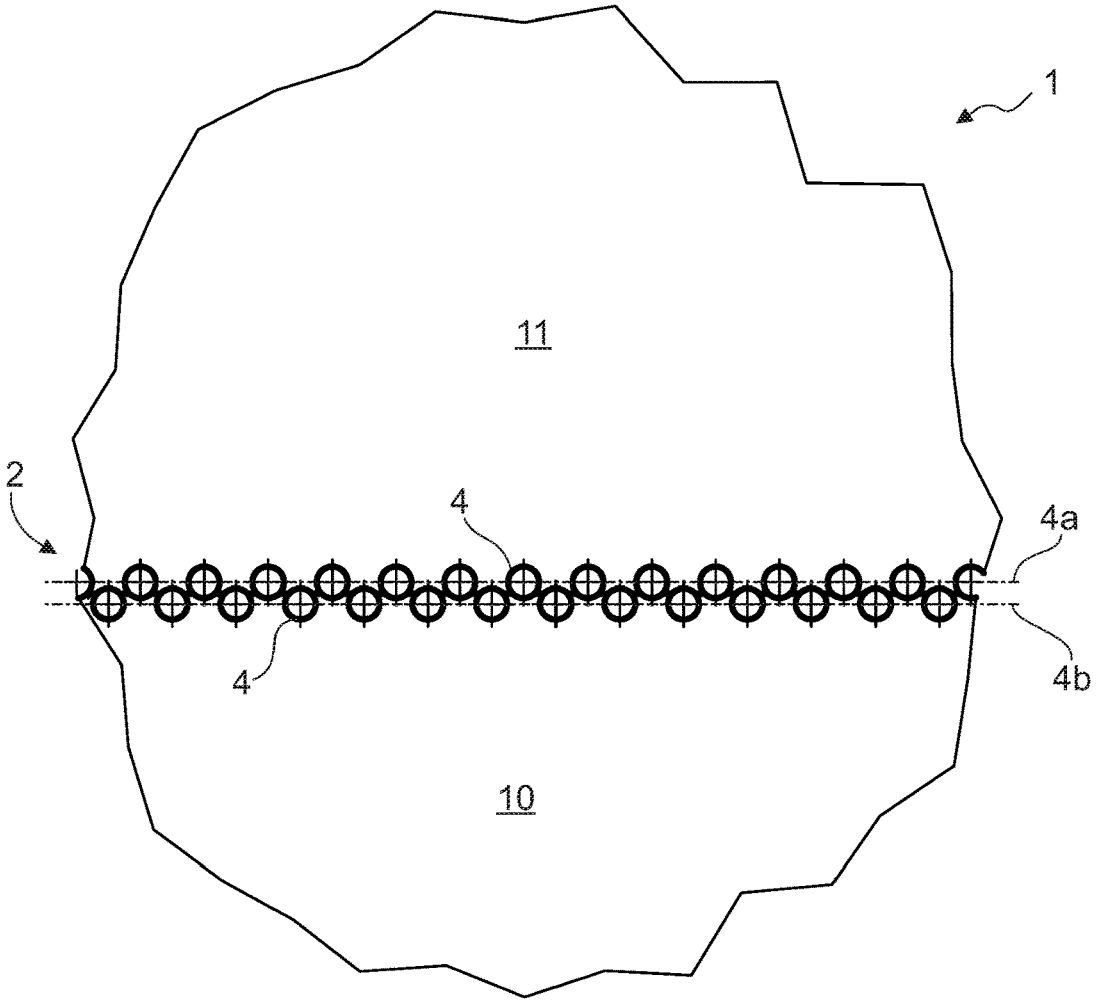
FIG. 7 shows the arrangement of the holes in another example of a cusp die for producing melt-blown non-woven fabric according to the invention.
Figure 8:
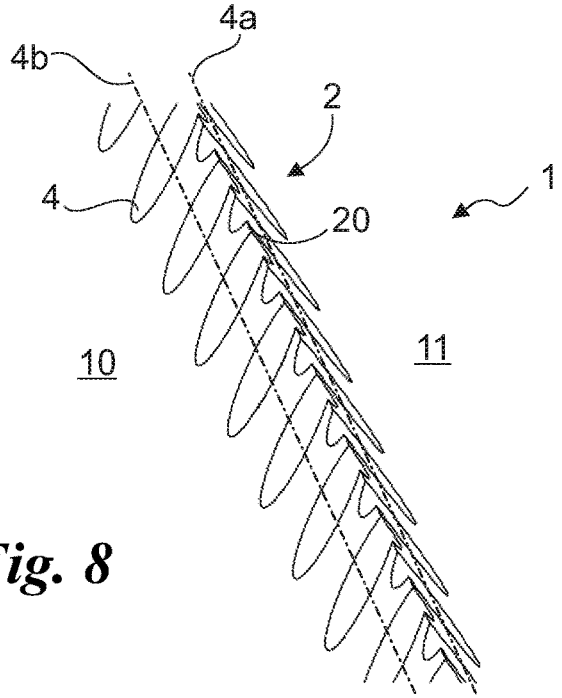
FIG. 8 illustrates the detail of the holes in the cusp die of FIG. 7 wherein the holes are distributed in such a way that they partially overlap the other of the sides.

In addition, the holes 4 could be distributed in such a way that they are basically tangent to the edge and could even partially overlap the other of the sides 10, 11, as shown in FIG. 7-8.

Of course, The rows 4*a*, 4*b* may be simply considered as the directions passing through the centre of the holes 4 of the respective row 4*a*, 4*b*.

From a geometric point of view, the holes 4 may be have any shape. However, the holes 4 are preferably, basically cylindrical.

In addition, the holes 4 preferably define a minimum diameter of 0.05 mm.

The arrangement of the holes 4 in more rows 4*a*, 4*b* in particular makes it possible to distribute the holes 4 across the ejection portion 2 with a linear density greater than 50 holes/inch as assessed along the main extension direction 1*b*.

Of course, the linear density of the arrangement of the holes 4 depends on the size of the holes 4 themselves. In any case, considering the minimum dimensions of the holes 4 that may be used in a die 1, the maximum linear density that can be obtained is approximately 280 holes/inch.

Even more conveniently, the maximum linear density is approximately 250 holes/inch.

With holes 4 that are approximately 0.3 mm in diameter, which the common dies include with a linear density ranging from 30 to 50 holes/inch, the die 1 can obtain distributions greater than 50 holes/inch, thanks to the distribution of the holes 4 along the separate rows 4*a*, 4*b*. Preferably, even distributions greater than 70 holes/inch.

Basically, for any dimension of holes 4, the die 1 makes it possible to always obtain a high linear density of distribution with a consequent increase in the flow rate of the polymeric fluid ejected by the ejection portion 2.

This density can be achieved thanks to the arrangement of the holes 4 as conceived in the embodiments described above.

Of course, the densities may be increased, in line with the dimensions of the holes, including by adding more rows.

In addition, it should be noted that the linear density is assessed by considering the projections of the various holes 4 on the sagittal plane 1*a* along the main extension direction 1*b*.

The plant that includes the die 1 may, in conclusion, also comprise a container.

The container is preferably designed to collect the polymer particles in such a way that the non-woven fabric is produced. It is basically a moveable piece of equipment, for example one defined by a conveyer belt in continuous movement.

The container is basically arranged below the die 1, when the latter is in use in a melt-blown plant, and is configured to receive polymer filaments from the holes 4.

The latter face the container so as to convey, by gravity and with the aid of the air coming from the air blades, the polymeric fluid to the container.

The container 6 preferably defines a collection direction basically parallel to the main extension direction 1*b*.

The operation of the die to produce the melt-blown non-woven fabric 1 previously described in structural terms is basically identical to that of any prior art die.

The melt-blown plant that includes the die 1, in any case, enables the production of a high-quality melt-blown non-woven fabric.

In fact, the die for producing the melt-blown non-woven fabric 1 according to the invention entails significant advantages.

The die 1 enables the drastic reduction in empty spaces between one fibre and another of the non-woven fabric in order to increase the barrier to water or air created by the fabric itself.

These features are obtained without altering the operation of the die 1 compared to the prior art dies in such a way as to make any, already-existing melt-blown plant easy to convert.

The die 1, therefore, makes it possible to increase the efficiency of the melt-blown plants on which it is mounted and to produce high-performance non-woven fabrics. Another advantage is that it is also possible to increase the number of extrusion pipes 3 in the die 1, increasing, at the same time, the flow rate or throughput of the polymer.

Variations may be made to the invention that fall within the scope of the inventive concept defined in the claims.

In particular, at least part of the ejection portion 2 can include a surface chrome-plating designed to reduce the porousness of the contact surface between the polymeric fluid and the ejection portion 2, increasing, therefore, the fluidity of the fluid coming out the holes 4 and passing over part of the ejection portion 2. At least part of the ejection portion 2 between the holes 4 therefore includes, if present, the surface chrome-plating.

In a melt-blown plant that includes the die 1, the surface chrome-plating can also be extended to the air blade or air knife to additionally increase the plant's efficiency.

Therefore, at least one of either the ejection portion 2, in particular the part of said ejection portion 2 between said holes 4, and the air blade preferably comprises a surface chrome-plating designed to increase the flow of the polymeric fluid.

In addition, it should be noted that the holes 4 arranged in the rows 4*a*, 4*b* can be of different dimensions, i.e. they can each have different diameters. For example, both the diameters of the holes 4 on the same row 4*a*, 4*b* may vary, and, alternatively or in addition, the diameters of the holes 4 between the different rows 4*a*, 4*b* may also vary.

In this context, all details can be replaced by equivalent elements, and the materials, shapes, and dimensions may be any materials, shapes, and dimensions.

The invention claimed is:

1. A cusp die for producing melt-blown non-woven fabric defining a sagittal plane, a main extension direction on said sagittal plane, a first flank and a second flank mutually bounded by said sagittal plane and comprising an ejection portion extending along said main extension direction and designed to convey, in use, polymeric fluid towards an external air blade, at least one extrusion pipe configured to convey said polymeric fluid towards said ejection portion, a plurality of holes arranged in said ejection portion, placed in fluidic through connection with said extrusion pipe and communicating with the outside, wherein said holes are arranged along at least a first row and a second row that are distinct and arranged respectively at said first flank and said second flank, wherein said ejection portion exclusively defines an edge extending on said sagittal plane parallel to said main extension direction and said first row and said second row are specularly placed side-by-side in relation to said edge, wherein said holes are arranged on said first row and said second row alternately so that none of said holes are placed side-by-side with another of said holes along a direction perpendicular to said sagittal plane, and wherein said holes are distributed in such a way that they are basically tangent to the edge or partially overlap the other of the flanks relative to the flank in which said holes are respectively arranged.

2. The die according to claim 1, wherein said first row and said second row are parallel to said main extension direction.

3. The die according to claim 1, wherein said first row and said second row are arranged specularly in relation to said sagittal plane.

4. The die according to claim 1, wherein said holes are cylindrical, define a minimum diameter of 0.05 mm and are distributed on said ejection portion with a maximum linear density of 280 holes/inch along said main extension direction.

5. A melt-blown non-woven fabric plant comprising a die according to claim 1.

6. The plant according to claim 5, comprising, in addition, an air blade, wherein at least one of either a part of said ejection portion between said holes and said air blade comprises a surface chrome-plating designed to increase the flow of said polymeric fluid.

7. A cusp die for producing melt-blown non-woven fabric defining a sagittal plane, a main extension direction on said sagittal plane, a first flank and a second flank mutually bounded by said sagittal plane and comprising an ejection portion extending along said main extension direction and designed to convey, in use, polymeric fluid towards an external air blade, at least one extrusion pipe configured to convey said polymeric fluid towards said ejection portion, a plurality of holes arranged in said ejection portion, placed in fluidic through connection with said extrusion pipe and communicating with the outside, wherein said holes are arranged along at least a first row and a second row that are distinct and arranged respectively at said first flank and said second flank, wherein said ejection portion defines two edges extending parallel to said main extension direction and a flat surface perpendicular to said sagittal plane, bounded by said edges and extending along said main extension direction, wherein said first row and said second row extend parallel to said edges beyond said flat surface in such a way that none of said holes extend on said flat surface.

* * * * *